United States Patent [19]

King

[11] 4,255,158

[45] Mar. 10, 1981

[54] GASOLINE AND PETROLEUM FUEL SUPPLEMENTS

[76] Inventor: Samuel B. King, 2985 McGavock Pike, Nashville, Tenn. 35214

[21] Appl. No.: 135,171

[22] Filed: Mar. 28, 1980

Related U.S. Application Data

[63] Continuation-in-part of Ser. No. 103,462, Dec. 14, 1979, which is a continuation-in-part of Ser. No. 85,339, Oct. 16, 1979.

[51] Int. Cl.[3] ..... C10L 1/18

[52] U.S. Cl. ..... 44/56

[58] Field of Search ..... 44/53, 56, 51, 57, 77

[56] References Cited

U.S. PATENT DOCUMENTS

| | | | |
|---|---|---|---|
| 1,684,686 | 9/1928 | Records | 44/53 |
| 3,765,840 | 10/1973 | Brent | 44/51 |
| 4,020,798 | 5/1978 | Skala | 123/1 A |
| 4,081,252 | 3/1978 | Osborg | 44/53 |
| 4,088,454 | 5/1978 | Lee | 44/56 |
| 4,110,082 | 8/1978 | Van Michaels-Christopher | 44/50 |

*Primary Examiner*—Winston A. Douglas
*Assistant Examiner*—Y. Harris-Smith
*Attorney, Agent, or Firm*—Nicholas J. Aquilino

[57] ABSTRACT

A gasoline and petroleum fuel supplement formed of a combination of ingredients including a lower alkanol selected from the group consisting of methyl alcohol, ethyl alcohol, n-propyl alcohol, i-propyl alcohol and mixtures thereof and an alkali metal hydroxide selected from the group consisting of sodium hydroxide, potassium hydroxide, lithium hydroxide and mixtures thereof. These ingredients may be added in various ratios to gasoline and/or to water, preferably distilled or deionized water, for use as fuel supplements for internal combustion engines.

14 Claims, No Drawings

GASOLINE AND PETROLEUM FUEL SUPPLEMENTS

RELATED APPLICATIONS

The present application is a continuation-in-part of application Ser. No. 103,462, filed Dec. 14, 1979, entitled Gasoline and Petroleum Fuel Supplements, which application is a continuation-in-part of application Ser. No. 85,339, filed Oct. 16, 1979, entitled Gasoline and Petroleum Fuel Supplements. Reference is also made to applicant's copending application Ser. No. 38,288, filed May 11, 1979, entitled Gasoline and Petroleum Fuel Supplement relating to a similar fuel supplement with a different combination of ingredients.

BACKGROUND OF THE INVENTION

The present invention relates to a new gasoline and petroleum fuel supplement for use in internal combustion engines which results in or causes more complete combustion of the fuel in the engine and a reduction in the overall amount of pollution emitted from the engine exhaust.

Some reasons for present inefficiencies of gas as fuel in the present internal combustion engine include that the gasoline vapor is diluted with about 68 times its volume of air, 4/5 of which is inert nitrogen taking no part in the reaction, but rather tending to hinder and retard the combustion. This mixture under ordinary pressure would not burn, much less explode. The compression of this mixture before explosion can be taken to be about 80 pounds per square inch owing to the risk of premature ignition. Explosion then takes place with such rapidity that its diluting action of the inert nitrogen prevents complete combustion. Results of the incomplete combustion thus caused are low efficiency, carbon deposits in the engine, unburned blow-by vapors of poisonous gases, hydrocarbons, monoxides and the like which now attend the present gasoline powered motor.

It is known that a temperature of about 1200° C. is needed to ignite the ordinary gasoline and air mixture at atmospheric pressure. At the moment of explosion, such portions of hydrocarbons as do not happen to be in contact with the proper quantity of oxygen required for their combustion, owing to the hindering action of the inert nitrogen, undergoes changes of various complexity. The result is that the products of combustion contain not only products of complete combustion but also the products of incomplete combustion. These are formed by the heat at the moment of explosion and these products combined with lubricants provide odors associated with gasoline motors and also deposit films of carbon on the inside of the cylinders.

Prior art patents relating to internal combustion engines and novel fuel compositions therefor are shown, for example, in the patents to Brent U.S. Pat. No. 3,765,848 relating to a motor fuel composition; Skala U.S. Pat. No. 4,020,798 for an internal combustion engine fueld by NAK; Osborg U.S. Pat. No. 4,081,252 for a method of improving combustion of fuels and fuel compositions; Records U.S. Pat. No. 1,684,686 describing an aqueous liquid fuel; Lee U.S. Pat. No. 4,088,454 for a method for producing a liquid fuel composition; and Michaels-Christopher U.S. Pat. No. 4,110,082 for a reformed hydrocarbons and alcohols from fuel alloys and reforming agents.

The present fuel supplement is a newly created formulation of chemicals which may be combined with gasoline and/or water to provide more complete combustion when used with gasoline in the present day internal combustion engine. The present mixture and ratio between the ingredients and the amount of gasoline is determined by the construction of the motor, weight of the vehicle and conditions of operation.

It is to be understood that the various chemicals and water, preferably distilled or deionized water, as described herein may be mixed in various desirable proportions in accordance with different internal combustion engines, and various features thereof including compression ratios, weights and other varying factors.

The present supplement provides increased gasoline mileage of up to 50% or more. It produces a gaseous vapor which causes the blow-by vapors in the engine to burn more completely when they become united in the motor. Consequently, the normally harmful, dangerous and wasted hydrocarbons and other gases as well as the inert nitrogen gases which are currently wasted, burn more cleanly during combustion.

This provides a reduced level of air pollution from internal combustion engines and reduces oil contamination.

The use of the supplement provides cleaner engine parts due to a cooler running cycle, less carbon deposits inside the engine as well as less gases entering the crank case to contaminate the oil. This produces some expected longer life of oil, parts and engines. The supplement reduces combustion heat and allows engines to run cool and, in some instances, may possibly reduce the gasoline octane rating required for internal combustion engines.

The fuel supplement is formed of a combination of essential ingredients in the following relative proportions: 250 to 3,000 ml of a lower alkanol, such as methyl alcohol, ethyl alcohol, n-propyl alcohol, i-propyl alcohol or mixtures thereof, and 0.75 gr to 120 gr of an alkali metal hydroxide, such as sodium hydroxide, potassium hydroxide, lithium hydroxide or mixtures thereof. The sodium hydroxide and/or potassium hydroxide and/or lithium hydroxide may be added to the lower alkanol ingredients in solid form in the above stated proportions or may, in the alternative, be added in the form of an aqueous solution. When an aqueous solution of the hydroxides is used, the solutions may comprise, for example, from about 150 to 4,000 g/l of the respective hydroxides. Obviously, the size of the batch of fuel supplement produced is a matter of choice so long as the relative proportions of ingredients is maintained as stated above.

When the above ingredients forming the supplement are mixed together, the total mixture is then mixed either with gasoline or with water. In a preferred embodiment, the above ingredients are mixed with distilled or deionized water. When the supplement is mixed with the distilled or deionized water, the final product comprises from about $\frac{1}{4}$ to about $\frac{3}{4}$ by volume supplement and the remainder water. When the supplement is mixed with gasoline, the product comprises from about 70 to about 95% by volume of supplement and from about 5% to about 30% by volume of gasoline.

Either of these mixtures may be injected or otherwise added to the carburation system of an internal combustion engine, for example, at the PCV valve, carburetor intake manifold or to each cylinder. A carburetor intake manifold converter may also be used to inject and vaporize the supplement. Alternately, the supplement may be added directly to the gasoline in the fuel tank. It has been found that adding to the fuel tank approximately one ounce of supplement per gallon of fuel achieves the desired results.

The advantages of the invention will be appreciated more fully in view of the following examples.

EXAMPLE 1

A fuel supplement was added in a 1968 Pontiac Le Mans Sedan having a 350 V8 engine weighing 3,620 pounds registered weight. The supplement was formed by mixing approximately 33% by volume of supplement with 66% distilled water. The supplement was prepared by mixing 1,000 ml of methyl alcohol, 1,000 ml of ethyl alcohol, 7.5 gr of sodium hydroxide and 7.5 gr of potassium hydroxide. The mixture was added slowly to the distilled water in the above proportions. The supplement was added to the intake manifold through the PVC line and the supplement was vaporized and the gaseous vapors were added through the carburetor to the combustion chamber using the intake manifold converter. The mileage increased from 15 miles per gallon, without using the supplement, to 25 to 30 miles per gallon with the supplement.

EXAMPLE 2

Example 1 was repeated except that the supplement was added through the positive crank case ventilation system. A similar increase in mileage was evidenced.

EXAMPLE 3

Example 1 was repeated except that an additional 1,000 ml of methyl alcohol was used in place of the ethyl alcohol of Example 1. A similar increase in mileage was evidenced.

EXAMPLE 4

Example 1 was repeated except that the ethyl alcohol and sodium hydroxide were deleted from the supplement. A similar, but slightly lower increase in mileage was evidenced.

EXAMPLE 5

Example 1 was repeated except that the ethyl alcohol and potassium hydroxide were deleted from the supplement. A similar increase in mileage was evidenced.

EXAMPLE 6

Example 1 was repeated except that the potassium hydroxide was deleted from the supplement, and the supplement was formed by mixing approximately 50% by volume of supplement with 50% distilled water. A similar increase in mileage was evidenced.

EXAMPLE 7

Example 6 was repeated except that the ethyl alcohol portion of the supplement was replaced with n-propyl alcohol. A similar increase in mileage was evidenced.

EXAMPLE 8

Example 6 was repeated except that i-propyl alcohol was used in place of the mixture of n-propyl alcohol and methyl alcohol. A similar, but slightly lower increase in mileage was evidenced.

EXAMPLE 9

Example 5 was repeated except that potassium was used in place of sodium hydroxide. A similar, but slightly lower increase in mileage was evidenced.

EXAMPLE 10

Example 5 was repeated except that lithium hydroxide was used in place of sodium hydroxide. A similar increase in mileage was evidenced.

It should be noted that gasoline octane ratings, driving and highway conditions will cause some variances in the miles per gallon when the supplement is used with the gasoline in various vehicles.

It will be understood that the above indicated combination of ingredients may be varied in keeping within the proportional ranges specified above. For example, other alcohols and alkali metal hydroxides may be interchanged and mixed with the above described ingredients to produce similar results.

What is claimed is:

1. A fuel supplement consisting essentially of a lower alkanol selected from the group consisting of methyl alcohol, ethyl alcohol, n-propyl alcohol, i-propyl alcohol and mixtures thereof, and an alkali metal hydroxide selected from the group consisting of sodium hydroxide, potassium hydroxide, lithium hydroxide and mixtures thereof, wherein the ingredients are employed in the following relative proportions: 250 to 3,000 ml of the lower alkanol and 0.75 to 120 gr of the alkali metal hydroxide.

2. A fuel supplement in accordance with claim 1 consisting essentially of methyl alcohol, ethyl alcohol, sodium hydroxide and potassium hydroxide wherein the ingredients are employed in the following relative proportions: 250 to 1,500 ml of methyl alcohol, 250 to 1,500 ml of ethyl alcohol, 0.75 to 60 gr of sodium hydroxide and 0.75 to 60 gr of potassium hydroxide.

3. A fuel supplement in accordance with claim 1 further including water wherein the water is present in an amount of from about 25% to about 75% of the total mixture by volume.

4. A fuel supplement in accordance with claim 1 further comprising gasoline, wherein the gasoline is present in from about 5% to about 30% by volume of the total mixture.

5. A fuel supplement in accordance with claim 2 wherein the water is deionized or distilled water.

6. The fuel supplement in accordance with claim 3 wherein the lower alkanol is ethyl alcohol and the alkali metal hydroxide is sodium hydroxide.

7. The fuel supplement in accordance with claim 6 wherein the lower alkanol is ethyl alcohol and the alkali metal hydroxide is potassium hydroxide.

8. The fuel supplement in accordance with claim 3 wherein the lower alkanol is methyl alcohol and the alkali metal hydroxide is sodium hydroxide.

9. The fuel supplement in accordance with claim 8 wherein the lower alkanol is methyl alcohol and the alkali metal hydroxide is potassium hydroxide.

10. The fuel supplement in accordance with claim 3 wherein the lower alkanol comprises a mixture of methyl alcohol and ethyl alcohol and the alkali metal hydroxide is sodium hydroxide.

11. The fuel supplement in accordance with claim 10 wherein the lower alkanol comprises a mixture of methyl alcohol and ethyl alcohol and the alkali metal hydroxide is potassium hydroxide.

12. The fuel supplement in accordance with claim 3 wherein the lower alkanol is methyl alcohol and the alkali metal hydroxide comprises a mixture of sodium hydroxide and potassium hydroxide.

13. The fuel supplement in accordance with claim 3 wherein the lower alkanol is ethyl alcohol and the alkali metal hydroxide comprises a mixture of sodium hydroxide and potassium hydroxide.

14. The fuel supplement in accordance with claim 2 further including water wherein the water is present in an amount of from about 25% to about 75% of the total mixture by volume.

* * * * *